US006408988B2

(12) United States Patent
Hani et al.

(10) Patent No.: US 6,408,988 B2
(45) Date of Patent: Jun. 25, 2002

(54) DISPLAY DEVICE HAVING MULTI SEGMENT DISPLAY WITH COMMON SEGMENTS

(75) Inventors: Robert Hani, Unterlunkhofen; Lukas Barmet, Lucerne; Hanspeter Keiser, Stansstad, all of (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/727,977

(22) Filed: Nov. 30, 2000

(30) Foreign Application Priority Data

Dec. 3, 1999 (EP) ..... 99811113

(51) Int. Cl.[7] ..... B66B 3/00
(52) U.S. Cl. ..... 187/391; 187/396
(58) Field of Search ..... 187/391–394, 187/396, 397, 399; 345/33, 38, 39, 40, 44, 45, 46

(56) References Cited

U.S. PATENT DOCUMENTS 4,092,638 A * 5/1978 Ripley ..... 340/336
4,240,074 A * 12/1980 Gibson et al. ..... 340/753
4,270,196 A * 5/1981 Terzian ..... 340/756
4,778,035 A 10/1988 Tanino
4,832,157 A * 5/1989 Kitano ..... 187/1 R
4,914,730 A * 4/1990 Fujita ..... 340/756
4,918,428 A 4/1990 Bebel
5,042,620 A * 8/1991 Yoneda et al. ..... 187/124
5,325,022 A * 6/1994 Proctor ..... 187/137
5,450,095 A * 9/1995 Nagoya ..... 345/33
5,623,273 A * 4/1997 Asai ..... 345/33
5,844,181 A * 12/1998 Amo et al. ..... 187/396
5,884,577 A * 3/1999 Tanaka ..... 116/35 R

FOREIGN PATENT DOCUMENTS

DE 9404366.1 A1 9/1994
GB 2052825 A1 1/1981

* cited by examiner

*Primary Examiner*—Jonathan Salata
(74) *Attorney, Agent, or Firm*—Schweitzer Cornman Gross & Bondell LLP

(57) ABSTRACT

A multi-segment display for the representation of alphanumeric characters, formed by uniting several character-display elements having multiple segments. The united display segment elements have common vertical segments. Greater freedom for representing the characters while requiring the smallest possible number of segments is obtained by such a construction. In addition, gaps between character representation can be minimized or eliminated, allowing characters to be represented in a centered arrangement with a regular spacing.

7 Claims, 6 Drawing Sheets

DISPLAY DEVICE HAVING MULTI SEGMENT DISPLAY WITH COMMON SEGMENTS

The present invention relates to a multi-segment display for the representation of alphanumeric characters.

BACKGROUND OF THE INVENTION

For displaying figures, characters, symbols, and alphanumeric characters, for example in elevator installations, 7- and 16-segment displays are known, as described, for example, in U.S. Pat. No. 4,778,035 and DE-U-9404336.

These segment displays have a standard character set, are only available as individual modules for the employ of individual characters, and always remain in the form of separate elements when they are placed adjacent to each other.

The spaces between figures to be displayed upon two adjacent display elements are constant. This results in, for example, the combination of the FIG. "1" with other figures having an unattractively wide spacing, or impairs readability of the figures. Lengthy character strings cannot be represented.

BRIEF DESCRIPTION OF THE INVENTION

A multi-segment display according to the present invention has adjacent character-display elements sharing common segments. This has the advantage of enabling greater freedom in representation of the displayed characters while requiring the smallest possible number of segments. By the elimination of gaps, the characters can be represented with regular spacing and the information is clearly readable even in the case of lengthy character strings.

Extended displays, having a plurality of individual character-display elements can be constructed to allow the display of multiple-character information in a compact, centered, and highly visible and legible manner.

It is advantageous for the display elements to be of a type which allows the displayed characters to be alphanumeric characters, so that not only individual figures, but also letters and information of all types, can be displayed.

An advantageous embodiment is to be seen in a display of the invention consisting of a union of several elements, and preferably three elements. By this means, and to the extent that it is appropriate, the display can have elements added to it without limit to enable lengthy character strings to be clearly and flexibly represented. Moreover, the characters can be represented centrally on the display. The arrangement of the segments also permits characters with different font widths always to be represented centered in the display.

In a further embodiment, the segments are individually switchable by a control module, preferably a computer. Centering of the character strings and adjustment of the font width can take place automatically.

BRIEF DESCRIPTION OF THE DRAWINGS

Various exemplary embodiments of the invention are illustrated in the diagrammatic drawings and explained in more detail in the description below, wherein.

DETAILED DESCRIPTION OF THE INVENTION

Figure 1:
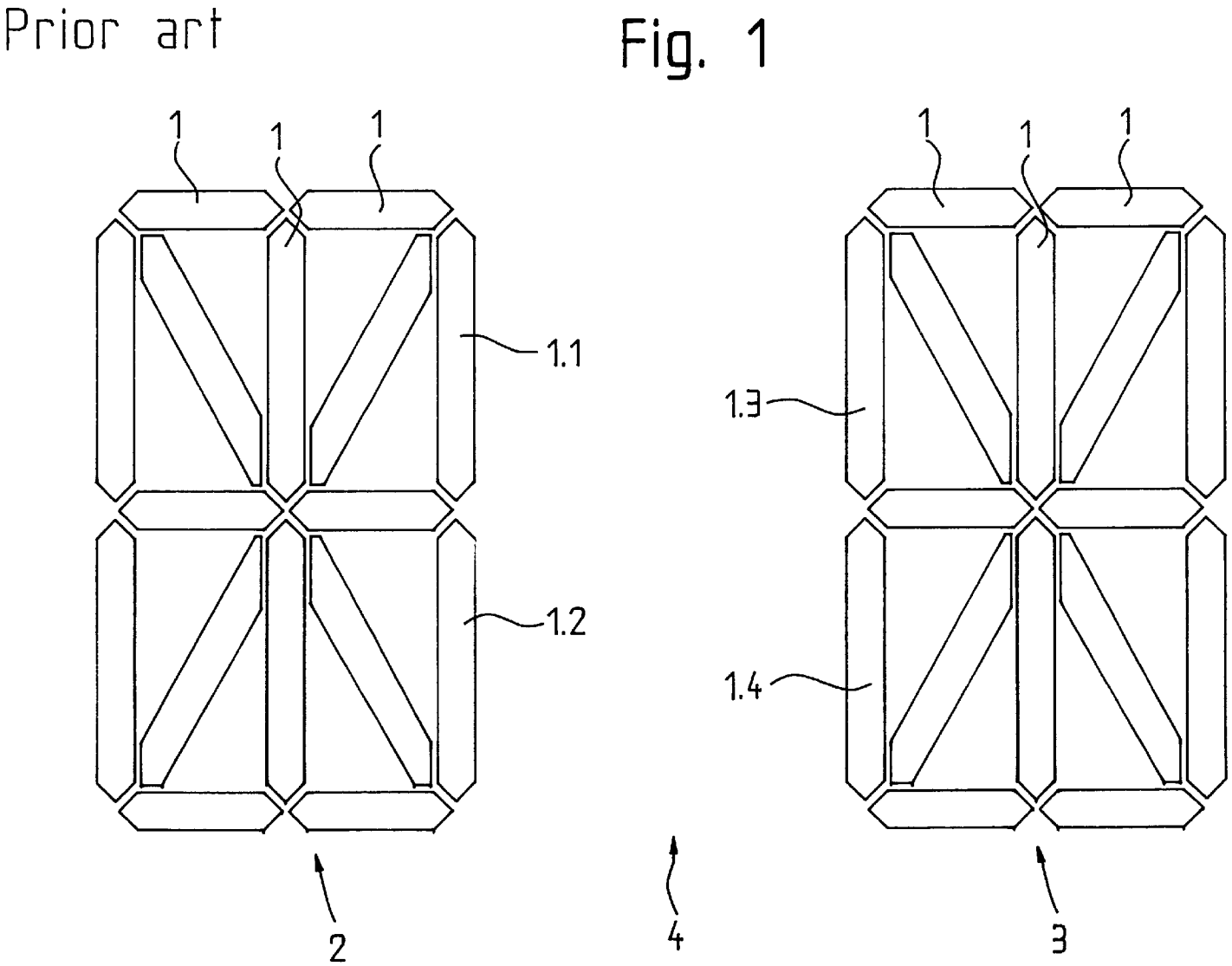
Fig. 1 Prior art
FIG. 1 depicts two 16-segment displays according to the present state of the art.

In FIG. 1, two identical, adjacent displays 2 and 3 illustrative of the state of the art, e.g. according to U.S. Pat. No. 4,778,035 or DE-U-9404336, are illustrated, each consisting of sixteen segments 1. Among the segments 1 are two vertical segments 1.1 and 1.2, and two vertical segments 1.3 and 1.4, which are positioned at the right-hand edge of display element 2 and the left-hand edge of display element 3, respectively. A gap 4 extends between the two display elements.

Figure 2:
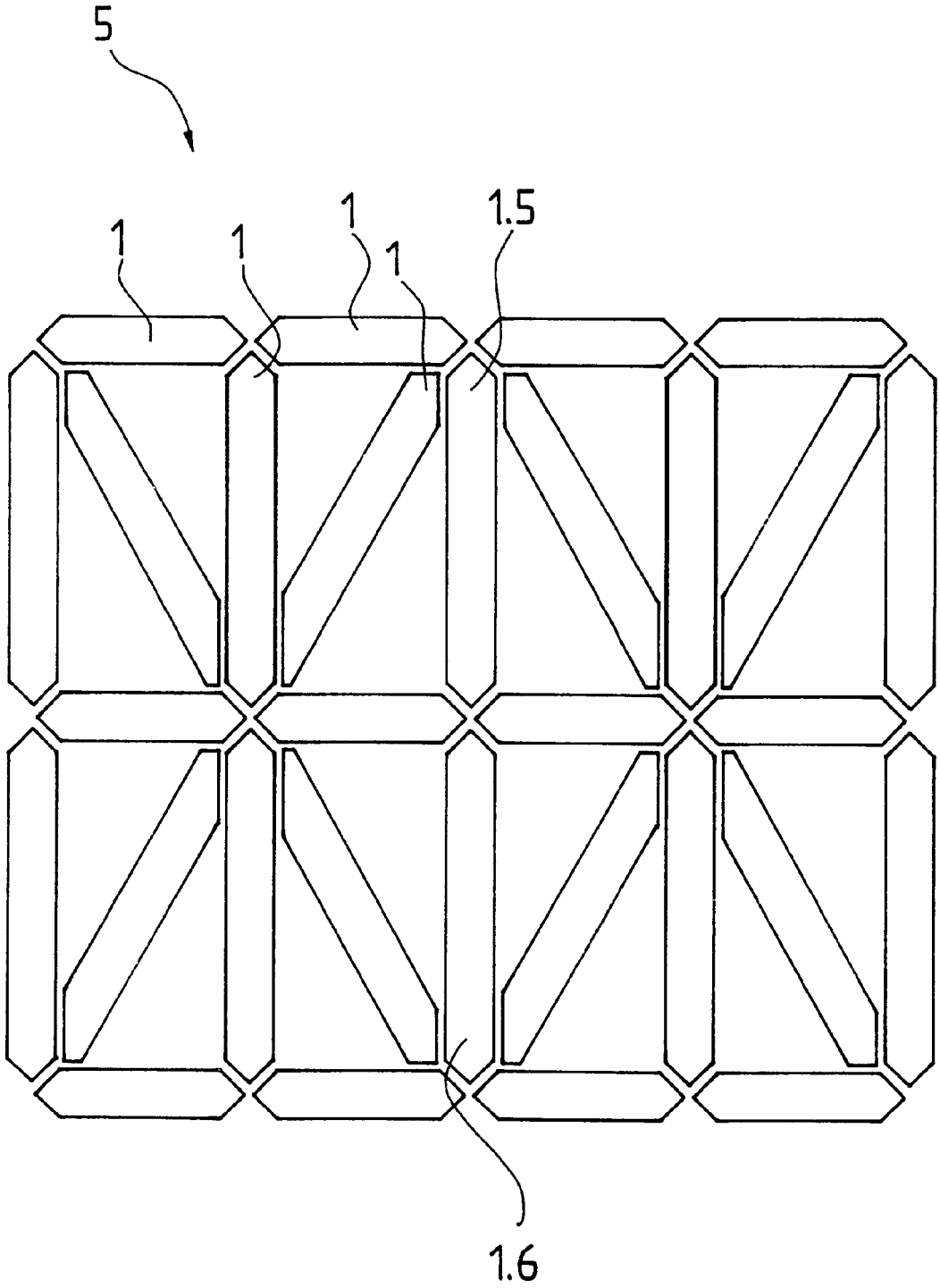
FIG. 2 depicts a multi-segment display according to a first embodiment of the invention.

In FIG. 2 a multi-segment display 5 according to the invention, consisting of thirty segments 1, is illustrated as a first exemplary embodiment.

In distinction to the conventional elements according to FIG. 1, the two vertical segments 1.1 and 1.2 at the right-hand edge of the left-hand 16-segment element 2 and the two vertical segments 1.3 and 1.4 at the left-hand edge of the right-hand 16-segment element 3 are replaced by the two common segments 1.5 and 1.6 in FIG. 2. The display thus has a continuous segment field without the gap 4 usual with the original segment displays 2 and 3. The resultant multi-segment display 5 has fewer segments 1 than in the state of the art, and enables more flexible representation. Furthermore, the alphanumeric characters can be represented with regular spacing.

Figure 3:
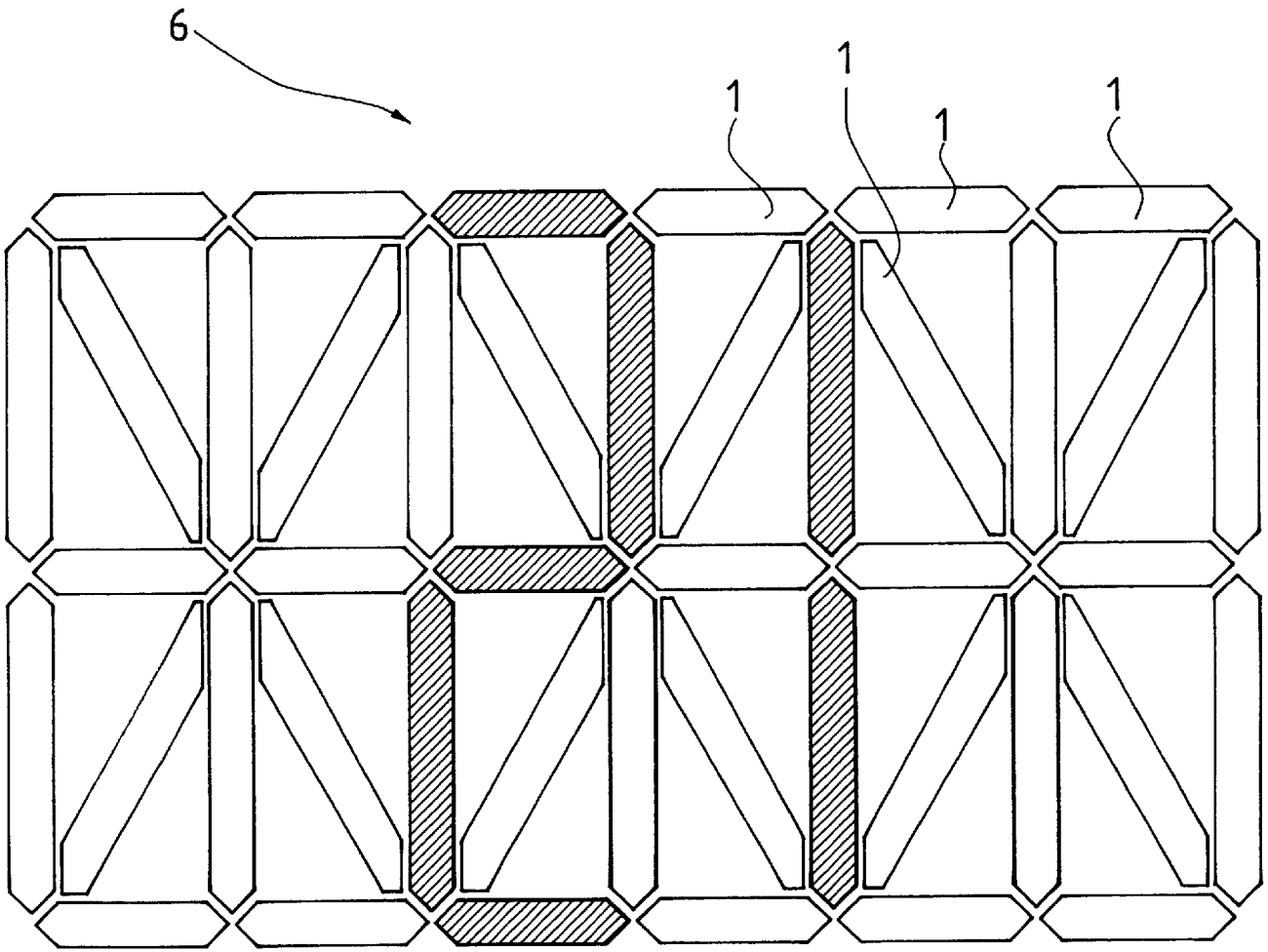
FIG. 3 depicts a multi-segment display according to a second embodiment of the invention.

In FIG. 3 a multi-segment display 6 is illustrated which consists of a composite of three 16-segment elements in the sense of the invention. Instead of a 48-segment display comprising three independent 16-segment elements at a distance from each other, the result is a more compact 44-segment display 6, which allows a more flexible representation of characters with fewer segments. For example, the number "21" can be represented exactly in the middle of the multi-segment display 6.

Figure 4:
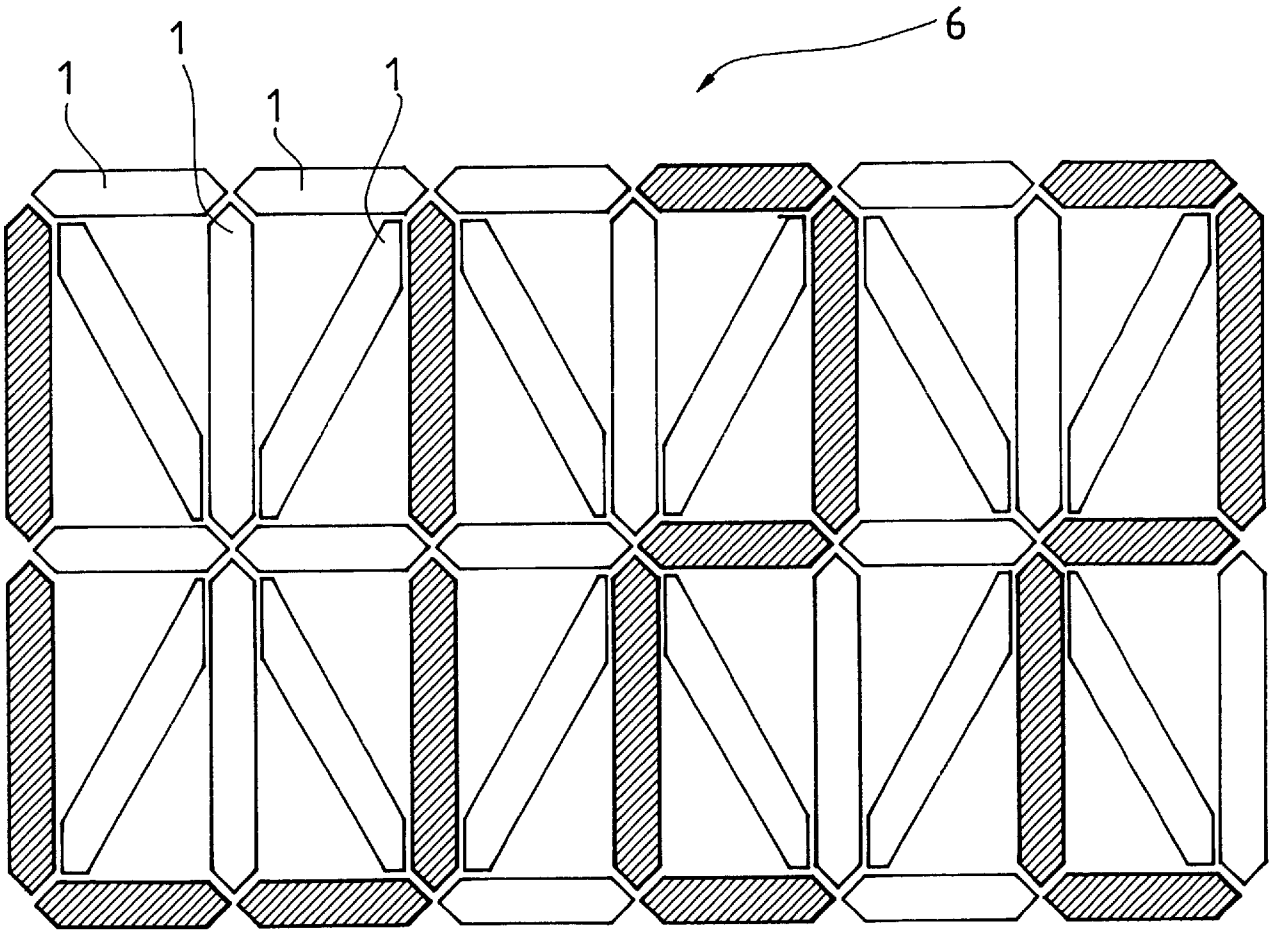
FIG. 4 depicts the multi-segment display according to FIG. 3 with a further example of a character representation being made thereby.

In FIG. 4 a further example is shown, in which a combination of letters and figures is represented with a regular spacing therebetween. Here too, the representation of a twenty-second floor below ground level (U22) is represented exactly centered in the display with uniform and appropriate spacing between the individual characters.

The length of the multi-segment display of the invention can be extended with additional elements as appropriate to enable the representation of lengthy character strings, there being at least one common segment between each pair of two adjacent elements. It is also possible to unite parts of individual 7- or 16-segment elements in the manner described for a composite display of such elements.

Depending on the desired layout, it is also possible for horizontal segments, as well as other segments, of the united elements to be common. Several 7-segment displays can also be united in the same manner.

Figure 5:
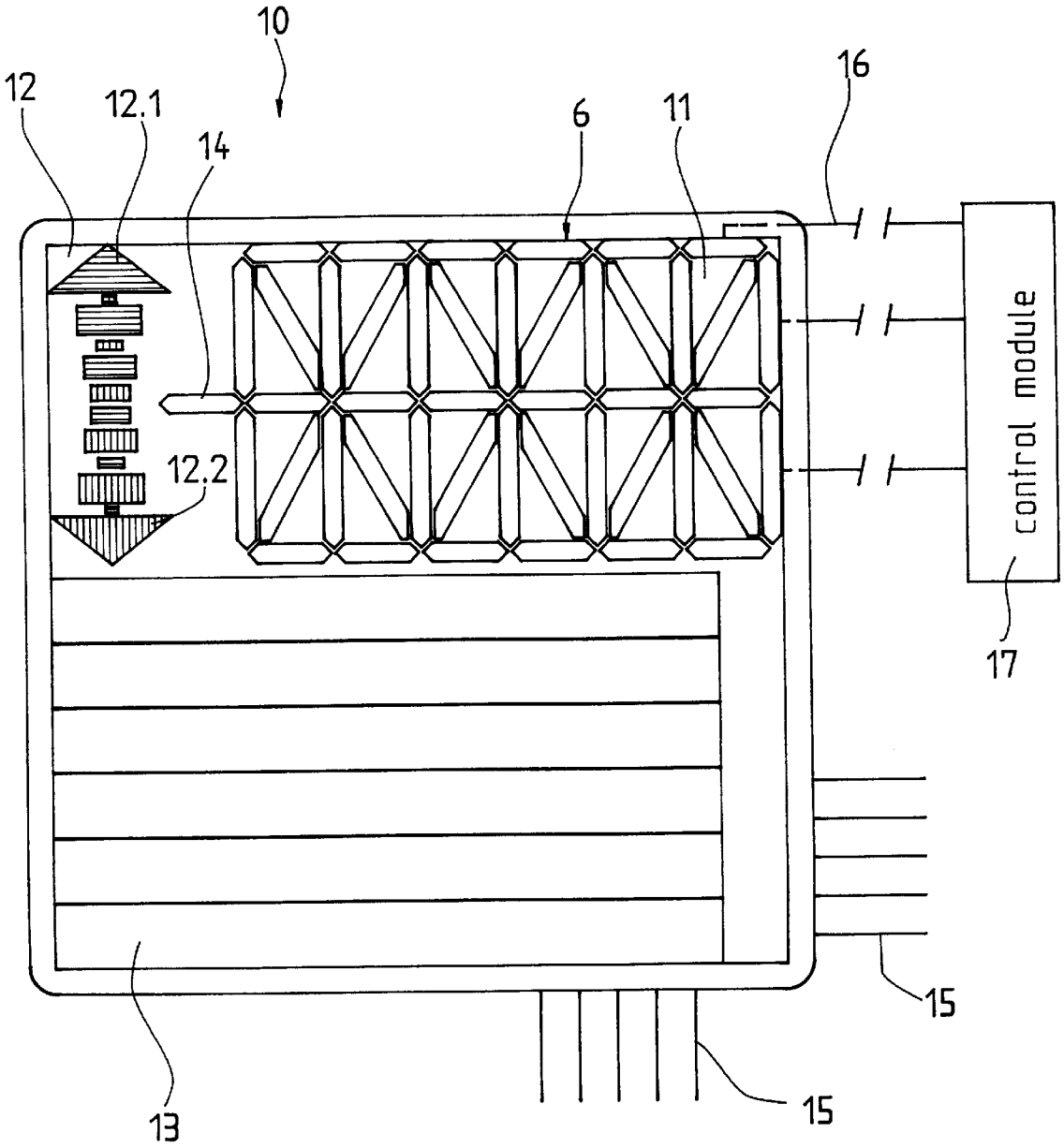
FIG. 5 depicts a display device of an elevator installation with an integral multisegment display according to the invention.
Figure 6:
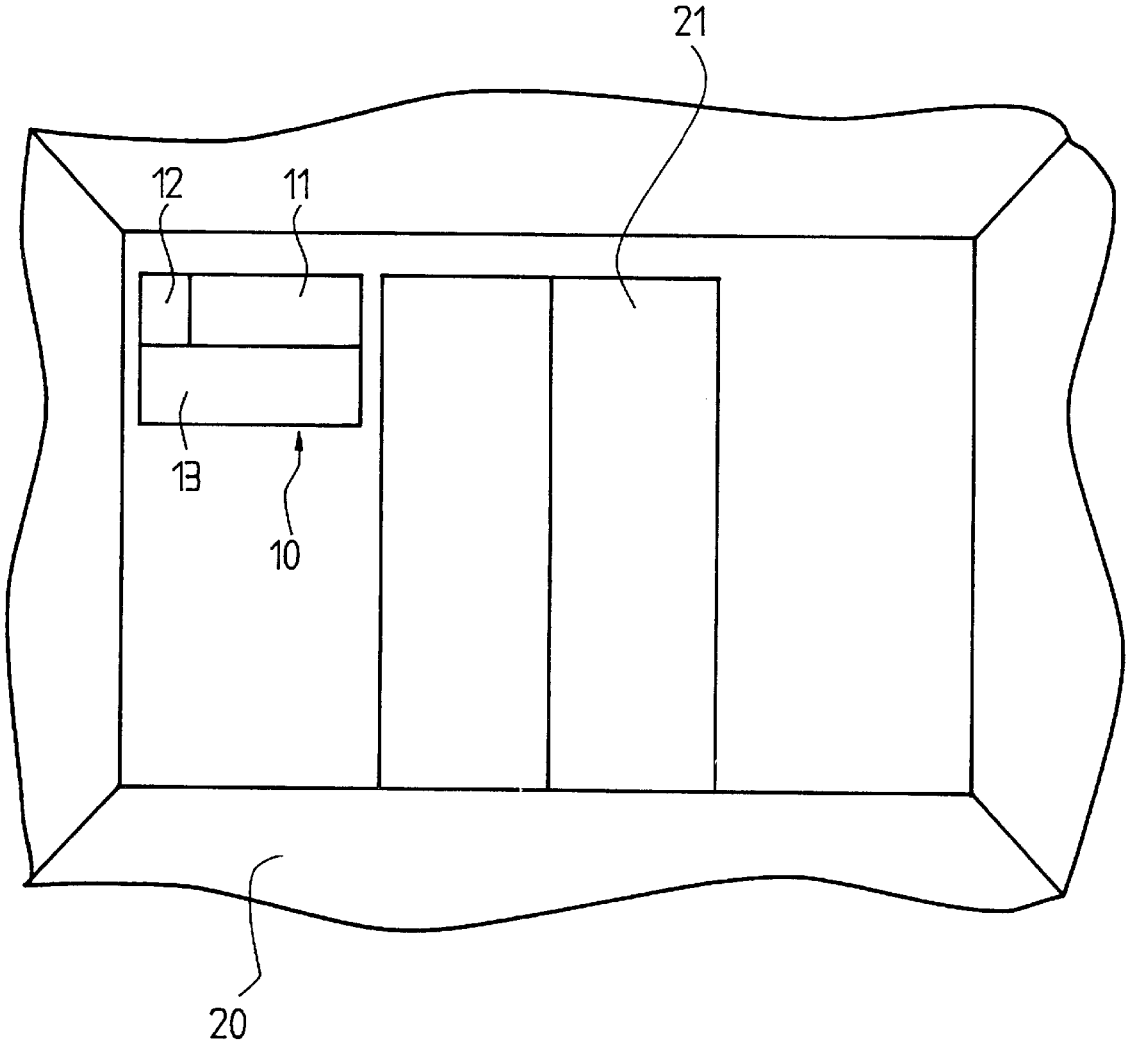
FIG. 6 depicts a display device in accordance with the invention installed in an elevator.

In FIG. 5 a multi-functional display device 10 for representing various items of information in an elevator installation, such as floor, direction of travel, status and alarm messages, etc. is illustrated. The display device 10 has three zones 11, 12, and 13. The first zone 11 contains a 44-segment multi-segment display 6 which can be provided with an additional segment 14 for a minus sign. The second zone 12 is provided with an "up" direction arrow 12.1 and a "down" direction arrow 12.2 to indicate the direction of travel. The third zone consists of pre-printed messages, as for example alarm messages, which are illuminated when such events occur. In this display 10 all possible messages for an elevator installation are contained. The display 10 can be installed both on the landings and in the elevator car, as depicted in FIG. 6, which depicts the display 10 in elevator car 20 located in a known manner adjacent to the doors 21, and may be controlled by a conventional control device. The various panels and displays are wired together by means of pluggable connectors or individual wires 15.

The segments of the multi-segment displays are individually wired and switchable. They are connected individually via conductors 16 to a control module 17, e.g. to a computer, as partially depicted in FIG. 5 by three conductors 16. The computer has electronic means which, by use of appropriate algorithms, control the illumination of the segments in such manner that the character strings to be displayed can be automatically centered in the display. In association therewith, the font width of individual characters can be increased and decreased to achieve good readability and centering.

The multi-segment display can preferably be executed through known electroluminescent thick-film technology, which may be manufactured by a silk screen process. Various display technologies as, for example, LCD, TFT, LED, lamps, etc. can also be used.

We claim:

1. A display device comprising a multi-segment display for representing varying multiple character information in elevator installations, the multi-segment display comprising at least two character display elements each having a plurality of segments, each character display element capable of independently and simultaneously with another of the display elements displaying a character of a multiple character display, characterized in that adjacently positioned character display elements have at least one common segment in the plurality of segments in both of the two character display elements, whereby a character displayed may be formed either by the segments of a single character display element or the segments of two adjacent character display elements including at least one common segment.

2. A display device according to claim 1, characterized in that the multi-segment display is an alphanumeric character display.

3. A display device according to claim 1 or 2, characterized in that the display device comprises a union of several display zones.

4. A display device according to claim 1 or 2, characterized in that the segments of the multi-segment display are individually switchable by a control unit.

5. A display device according to claim 4, further comprising a display element having an "up" and "down" direction arrow to represent travel direction.

6. A display device according to claim 5, further comprising pre-printed illuminable messages representing the status of the elevator.

7. A display device according to claim 1 or 2, wherein the character display elements are arrayed horizontally.

* * * * *